US011891789B2

(12) United States Patent
Milstein

(10) Patent No.: US 11,891,789 B2
(45) Date of Patent: Feb. 6, 2024

(54) ANGULAR OFFSET STACKING BUILDING BLOCK

(71) Applicant: Harel Milstein, Ramat Gan (IL)

(72) Inventor: Harel Milstein, Ramat Gan (IL)

( * ) Notice: Subject to any disclaimer, the term of this patent is extended or adjusted under 35 U.S.C. 154(b) by 207 days.

(21) Appl. No.: 17/340,024

(22) Filed: Jun. 6, 2021

(65) Prior Publication Data

US 2022/0389704 A1 Dec. 8, 2022

(51) Int. Cl.
*E04B 1/04* (2006.01)
*E04B 1/38* (2006.01)

(52) U.S. Cl.
CPC ..... *E04B 1/043* (2013.01); *E04B 1/383* (2013.01); *E04B 1/541* (2023.08); *E04B 2103/02* (2013.01)

(58) Field of Classification Search
None
See application file for complete search history.

(56) References Cited

U.S. PATENT DOCUMENTS 5,930,964 A * 8/1999 Boehning ..... E04C 1/41 52/375
2004/0040245 A1* 3/2004 Sinclair, Sr. ..... B29C 48/12 52/605
2007/0277472 A1* 12/2007 Sinclair ..... E04B 2/04 52/605
2012/0079783 A1* 4/2012 Nylin ..... E04B 2/8629 52/309.1
2013/0049259 A1* 2/2013 Hammer ..... B28B 7/007 425/457
2016/0130809 A1* 5/2016 Radford ..... C04B 28/10 264/277
2017/0022710 A1* 1/2017 Riccobene ..... E02D 29/025

FOREIGN PATENT DOCUMENTS

CA 2607638 A1 * 4/2008 ..... B28B 11/044

* cited by examiner

*Primary Examiner* — Joshua K Ihezie

(57) ABSTRACT

In some embodiments, a building block includes alignment elements that interlink with a similar block with a positional offset. For example, the positional offset may be linear and/or rotational. For example, the second cinder block may be rotated with respect to the first block on which it is supports. Optionally, protrusions from the top of the block are positioned to interlink to the vertical slots at a fixed offset between the blocks. Optionally, the protrusions are formed by channels on a mold and/or a mold head. In some embodiments, a structure may be built stacked blocks. Optionally, a decorative face is configured to form a continuous decorated surface across offset blocks. In some embodiments a building block includes a calibration feature. For example, the block may include a ridge on the top of the block that may be shaved and/or ground to adjust the height of the block.

11 Claims, 15 Drawing Sheets

ANGULAR OFFSET STACKING BUILDING BLOCK

FIELD AND BACKGROUND OF THE INVENTION

The present invention, in some embodiments thereof, relates to a building block and, more particularly, but not exclusively, to a self-aligning cement block for easy construction.

SUMMARY OF THE INVENTION

According to an aspect of some embodiments of the invention, there is provided a cement building block including: a protrusion from the top of the block; and a vertical slot through the block; wherein the block is configured for the protrusion to fit into the slot of a similar block when the similar block is placed onto the lower block at a predetermined offset.

According to some embodiments of the invention, the predetermined offset includes at least on of rotation of 90 degrees and rotation of 180 degrees.

According to some embodiments of the invention, the protrusion projects between 1 to 8 cm above a top face of the block.

According to some embodiments of the invention, the protrusion longer lateral dimension of between 4 to 30 cm.

According to some embodiments of the invention, the protrusion shorter lateral dimension of between 1 to 5 cm.

According to some embodiments of the invention, further including a calibration feature on a top face of the cement block configured to support the weight of the similar block and configured for trimming during manufacturing of the block.

According to some embodiments of the invention, the calibration feature includes a ridge on a top face of the cement block.

According to some embodiments of the invention, the ridge has a height of between 1 to 4 cm.

According to some embodiments of the invention, the ridge has a width of between ⅕ mm to 4 cm.

According to some embodiments of the invention, the cement block the calibration feature is trimmed to adjust a height of the cement block from a bottom face thereof to a top of the calibration feature to desired height within a tolerance of less than 4 mm.

According to some embodiments of the invention, the cement block further includes: a decorative face that produce continuous decorative surface across a lateral face of the lower block and the similar block.

According to some embodiments of the invention, the decorative face covers all lateral sides of the block.

According to some embodiments of the invention, the block has the form a ring and wherein the block is configured to form a pillar when a plurality of similar blocks is stacked one on top of the other at the predetermined offset.

According to some embodiments of the invention, the ring is square.

According to some embodiments of the invention, the ring is rectangular.

According to some embodiments of the invention, the ring is at least one of round and oval.

According to some embodiments of the invention, the cement block further includes an empty channel configured to form a continuous channel across the lower block and the similar block for positioning a reinforcing element.

According to some embodiments of the invention, the reinforcing element includes a length of rebar that is longer than the height of the block.

According to some embodiments of the invention, the reinforcing element includes concrete.

According to some embodiments of the invention, the reinforcing element includes a prestressing element.

According to an aspect of some embodiments of the invention, there is provided a method of calibrating a cement block including: molding the block with a calibration protrusion; and trimming the calibration protrusion after the molding.

According to some embodiments of the invention, the trimming is in line with the molding.

According to some embodiments of the invention, the protrusion protrudes from a face of the cement block and the protrusion has surface area less than 1/10 of a surface area of the face.

According to some embodiments of the invention, the protrusion includes a ridge on a top face of the cement block and wherein the molding includes forming the ridge with a mold head.

According to some embodiments of the invention, the method further includes conveying the cement block on a conveyer and wherein a long dimension of the protrusion is parallel to movement of conveying.

According to some embodiments of the invention, the trimming is performed after curing of the cement block.

According to some embodiments of the invention, trimming includes grinding.

According to some embodiments of the invention, the trimming is performed before curing the cement block.

According to some embodiments of the invention, trimming include at least one of shaving the protrusion and squashing the protrusion.

According to an aspect of some embodiments of the invention, there is provided a building block including: a flat bottom; a molded body; and a calibration protrusion.

According to some embodiments of the invention, the block contains no vertical undercuts allowing vertical removal of the block from a mold.

According to some embodiments of the invention, the calibration feature includes a protrusion from a face of the block and wherein the protrusion has surface area less than 1/10 of the surface area of the face.

According to some embodiments of the invention, the calibration feature includes a ridge on a top face of the block.

According to some embodiments of the invention, the protrusion is formed in the block before curing and then trimmed.

According to some embodiments of the invention, the building block where the calibration feature includes a top surface parallel to the flat bottom of the cement block.

According to an aspect of some embodiments of the invention, there is provided a method of building a structure including supplying a foundation; placing a first block on the foundation; stacking a second block similar to the first block onto the first block the stacking including offsetting the second block from the first block fixing and positioning of the second block by interlocking a protrusion of the first block into a slot of the second block.

According to some embodiments of the invention, the foundation includes a platform.

According to some embodiments of the invention, the stacking includes resting the second block onto a calibration ridge of the first block.

According to some embodiments of the invention, the offsetting includes rotating the second block in respect to the first block.

According to some embodiments of the invention, the rotating is 90 degrees.

According to some embodiments of the invention, the rotating is 180 degrees.

According to some embodiments of the invention, the fixing includes aligning a decorative face that extends across a joint face of the first and second block.

According to some embodiments of the invention, the fixing includes laying mortar between the first block and the second block.

According to some embodiments of the invention, the method further includes: supplying a kit including a set of interlinking blocks including the first block and the second block for producing the structure.

According to some embodiments of the invention, the placing includes placing a single block to form an entire layer of the structure.

According to some embodiments of the invention, the stacking includes stacking a single block to form an entire layer of the structure.

According to some embodiments of the invention, the method further includes building a decoratively faced column.

According to an aspect of some embodiments of the invention, there is provided a kit for building a structure including a plurality of interlinking blocks wherein each block of the plurality of blocks includes: a protrusion from the top of the block; and a vertical slot through the block; wherein each lower block of the plurality of blocks is configured for the protrusion of the lower block to fit into the slot of a second block the plurality of when the second block is placed onto the lower block at a predetermined offset.

According to some embodiments of the invention, the block further includes a calibration feature on a top face of the block configured to support the weight of the second block and configured for trimming during manufacturing of the block.

According to some embodiments of the invention, the calibration feature includes a ridge on a top face of the cement block.

According to some embodiments of the invention, the kit the calibration feature is trimmed to adjust a height of the block from a bottom face thereof to a top of the calibration feature to desired height within a tolerance of less than 4 mm.

According to some embodiments of the invention, the kit further includes: a decorative face that produce continuous decorative surface across a lateral face of the lower block and the second block.

According to some embodiments of the invention, the decorative face covers all lateral sides of the block.

According to some embodiments of the invention, each block has the form a ring and wherein the kit is configured to form a pillar when the plurality of blocks is stacked one on top of the other at the predetermined offset.

According to some embodiments of the invention, the ring is square.

According to some embodiments of the invention, the ring is rectangular.

According to some embodiments of the invention, the ring is at least one of round and oval.

According to some embodiments of the invention, the kit further includes an empty channel configured to form a continuous channel across the lower block and the second block for positioning a reinforcing element.

According to some embodiments of the invention, the reinforcing element includes a length of rebar that is longer than the height of the block.

According to some embodiments of the invention, the reinforcing element includes concrete.

According to some embodiments of the invention, each block includes an empty channel configured to form a continuous channel across another block of the plurality of blocks positioned at the predetermined offset for positioning a prestressing reinforcing element and wherein the kit further includes the prestressing reinforcing element.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1A:
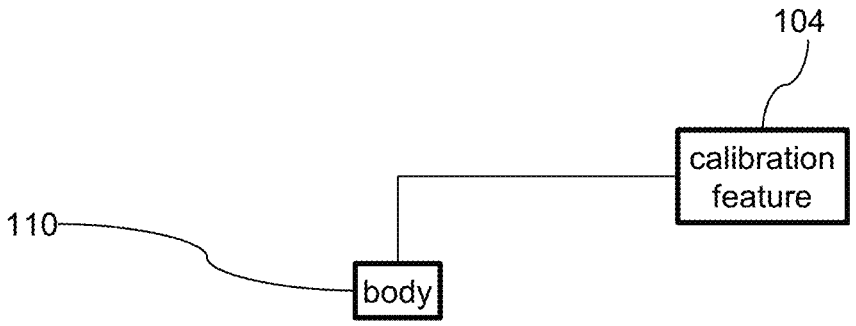
FIG. 1A is a block diagram illustration of a calibrated block in accordance with an embodiment of the current invention.

The present invention, in some embodiments thereof, relates to a building block and, more particularly, but not exclusively, to a self-aligning cement block for easy construction.

Overview

An aspect of some embodiments of the current invention relates to a building block having interlinking alignment elements. In some embodiments, a building block includes alignment elements that interlink with a similar block with a positional offset. For example, the positional offset may be linear and/or rotational. In some cases, a first cinder block may include a protrusion on a top surface that fits into a slot in the bottom a similar block offset from the first block. For example, the second cinder block may be rotated with respect to the first block that supports the second block from below. For example, each block may include a flat bottom and slots passing vertically through the entire block. Optionally, protrusions from the top of the block are positioned to interlink to the vertical slots at a fixed offset between the blocks. For example, a structure may be built of rows of offset blocks. Optionally, the blocks include a decorative face that is configured to form a continuous decorated surface across offset blocks. Optionally, the slots are formed by lateral protrusions on a mold and/or a mold head. Optionally protrusions are formed by a slot in a mold and/or a mold head.

An aspect of some embodiments of the current invention relates to a building block with a calibration feature (e.g. a ridge). In some embodiments the positioning of the blocks when building a structure is desired to be more precise than the size and/or shape of the body of the molded block. Optionally, a block will be calibrated to a desired tolerance after the block has been molded. In some embodiments, this calibration will be done on line as the block is produced. For example, the block may include a feature that determines a dimension of the block and/or is easier to calibrate that the body of the block. For example, the block may include a protrusion that may be shaped after molding the block. For example, the block may include a ridge on the top of the block that may be shaved and/or ground after molding (e.g. before and/or after curing) to adjust the height of the block.

An aspect of some embodiments of the current invention relates to a method of building a structure of interlocking offset blocks. Optionally, the blocks are self-aligning. Optionally, the blocks have decorative faces that form a continuous decorative face across offset blocks. For example, a column made be produced of blocks that are piled one on the other at an angular offset. Optionally, the blocks include self aligning features and/or calibration features. For example, a kit may include a plurality of self-aligning and/or self calibrating blocks. Optionally, the kit may include a base. In some, embodiments the kit may include a prestressing element (for example a bolt and/or a matching nut) to prestress the structure. Alternatively or additionally, the blocks may include a hole that aligns with a hole in a subsequen block at the predetermined offset configured to form a channel for a reinforcing element for example including rebar and/or concrete and/or a prestressing element.

In some embodiments a block will be made of aggregate and/or cement (for example a cement block and/or a cinder block). Alternatively or additionally, a block may include waste material (e.g. glass waste and/or pressed fiber and/or plastic waste) alternatively or additionally, a block may include a synthetic polymer and/or clay and/or ceramic.

EXEMPLARY EMBODIMENTS

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

FIG. 1A is a block diagram illustration of a calibrated block in accordance with an embodiment of the current invention. In some embodiments, a block may include a calibration feature 104. For example, a calibration feature 104 may include a protrusion from the block that in configured to facilitate determining a dimension of the block in a way that is relatively easy to adjust. For example, the protrusion may include a small volume of material compared to a face of a body 110 of the block and/or may be trimmed easily relative to the full face of the body 110 of the block.

In some embodiments, a protrusion on a face of the block may be configured to facilitate determining the positioning of the block with respect to an adjacent block (e.g. another block above, below and/or beside the block in a structure). The protrusion optionally has a surface area much less than the face of the block. For example, a dimension of the block can be adjusted by trimming the protrusion. This allows, in some embodiments, for calibrating one or more dimensions of the block relatively easily in comparison to what would be necessary to calibrate a full face of a traditional block. For example, a protrusion may be trimmed down to reduce a height of the block. For example, the trimming may be performed in line with block production. For example, trimming may include grinding a protrusion. In some embodiments, due to the small volume of the protrusion, grinding may produce a reduced quantity of dust than grinding an entire face of the block. Optionally, the protrusion is ground after the block cures. Alternatively or additionally, the protrusion may be shaved and/or squashed. For example, shaving and/or squashing may be performed before the block cures while the protrusion is soft. Optionally, trimming facilitates determining a precise dimension (e.g. height) of a block and/or achieving parallel surfaces (e.g. a feature on top of a block may be trimmed to make parallel a flat bottom of a block to a support surface on top of a block configured to support another block placed onto the support surface in a structure), before the block cures. For example, a blade may shave off an upper portion of the feature to achieve a desired height and/or a flat surface may be passed across the feature squashing and/or spreading the protrusions until it protrudes to a desired distance and/or achieves the desired block dimension.

For example, a block may include a ridge on a top face thereof. For example, the ridge of a lower block may be part of a support surface upon which a bottom of upper block is supported when the upper block is stacked on the lower block. For example, calibrating a support surface may facilitate building a wall of straight rows of blocks with reduced need to measure the height of each block and adjust the mortar to even up the rows. For example, the blocks may be pushed together so that they contact at the calibration feature. In some embodiments, a block may be positioned first and afterwards mortar used to fill space between faces of blocks. Alternatively or additionally, mortar may be laid before positioning the block, but the block will be positioned until it contacts the calibration feature of an adjacent block. Optionally the ridge is trimmed so that a top of the ridge is parallel to the bottom of the block. For example, the block may have a flat bottom.

In some embodiments a calibration feature may protrude away from a face of the block a distance between 1 to 4 cm and/or less than 1 cm and/or between 4 to 10 cm and/or between 10 to 20 cm. In some embodiments a calibration feature may have a short dimension along the face of the block (e.g. a width of a ridge) ranging between 1 to 4 cm and/or less than 1 cm and/or between 4 to 10 cm and/or between 10 to 40 cm. In some embodiments, a calibration feature may have a long dimension along the face of the block (e.g. the length of a ridge) ranging between 2 to 40 cm and/or between 40 to 200 cm and/or less than 2 cm. For example, the calibration feature may be trimmed to adjust a dimension of the block to a tolerance of within 1 to 4 mm of a desired dimension and/or within less than 1 mm tolerance and/or within 4 to 10 mm of the desired dimension and/or within 10 to 30 mm. In some embodiments a surface area of a calibration feature may be less than 1/10 the surface area of the face from which it protrudes and/or less than 1/5 and/or less than 1/3 and/or less than 1/20.

In some embodiments, a calibrated block may be formed with features to make of standards blocks and/or to make it compatible with a standard block making machine. For example, the block may have a flat bottom and/or may have no vertical undercuts. Optionally, a protruding calibration features may include a vertical ridge on a side of the block. Alternatively or additionally, a protruding calibration feature may include a vertical protrusion for a top the block.

Figure 1B:
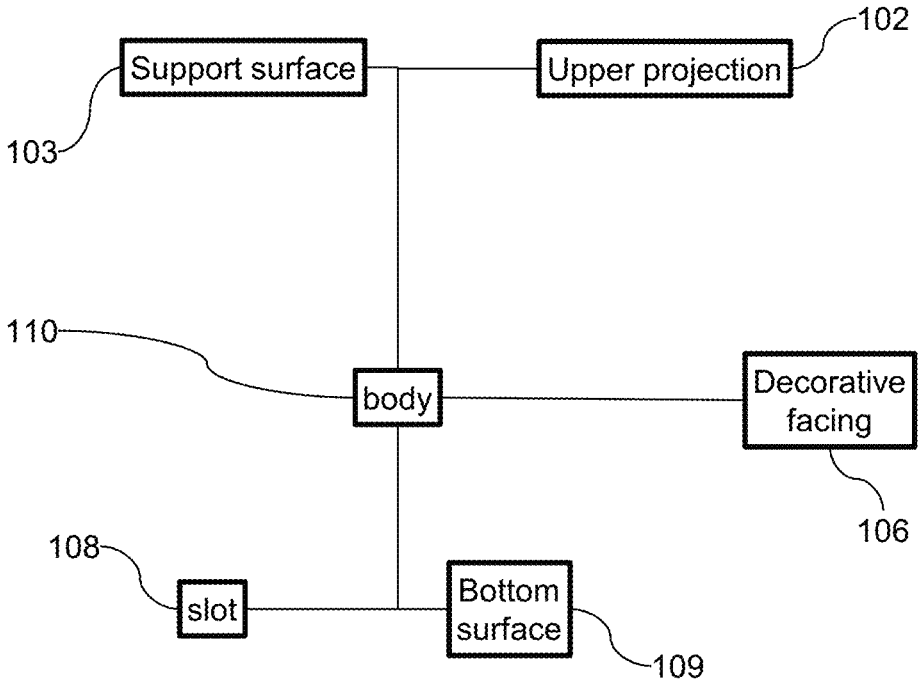
FIG. 1B is a block diagram illustration of a self-aligning decorative block in accordance with an embodiment of the current invention.

FIG. 1B is a block diagram illustration of a self-aligning decorative block in accordance with an embodiment of the current invention. In some embodiments, a first block includes a support surface 103 configured to support a bottom surface 109 of a similar block stacked on the first block. Optionally, both the first block and the similar block further include an upward protrusion 102 projecting above the supporting surface 103. Optionally, both the first block and the similar block further include a vertical through slot 108. In some embodiment, the block is configured for stacking at a fixed offset. For example, when the bottom surface 109 of the similar block is stacked onto the supporting surface 103 first block at the fixed offset, the upward protrusion 102 of the first block links to the and/or fits into the slot 108 in the similar block. In some embodiments, the offset may include a rotation. For example, the blocks may be configured to fit together when they are stacked one directly on top of the other with a relative rotation. For example, the relative rotation may be 90 degrees and/or 180 degrees and/or between 0 to 90 degrees and/or 90 to 180 degrees. Optionally, the relative rotation may be at an angle of symmetry of the block. For example, a square block may link at relative rotation offset of 90 and/or 180 degrees. For example, a rectangular block may fit to another block at a rotational offset of 180 degrees. For example, a hexagonal block may fit to another block at a rotational offset of 60 degrees and/or a multiple thereof. For example, a round block may fit to another block at a rotational offset of any angle. Alternatively or additionally, the offset may include a linear offset.

In some embodiments, an alignment feature on a block may have alignment features on a side thereof. For example, protrusion on one side of the block may fit a groove on an opposite side of the block. Optionally, when two blocks are placed side by side, the protrusion of one block may fit into the groove of a subsequent block. For example, each of the groove and/or protrusion may be a vertical line on the side of the blocks. For example, alignment features on a side of a block may be formed by a mold insert of a block making machine.

In some embodiments, a first block includes a protrusion 102 between 1 to 4 cm above a surface 103. For example, surface 103 may be a support surface for an upper block stacked on the first block. Alternatively or additionally, the protrusion may project between 4 to 8 cm above and/or less than 1 cm from the surface 103 and/or between 8 to 20 cm from the surface 103 and/or more than 20 cm from the surface 103. In some embodiments a long lateral dimension of an upward protrusion 102 ranges, for example, between 4 to 15 cm and/or between 15 to 30 cm and/or less than 4 cm and/or more than 30 cm. In some embodiments a short lateral dimension of an upward protrusion 102 ranges, for example, between 2 to 5 cm and/or between 8 to 15 cm and/or between 1 to 2 cm and/or less than 1 cm and/or more than 15 cm. In some embodiments, the block may include a decorative face 106. For example, the face may be configured to produce a continuous decorative face across two blocks when they are stacked together at the fixed offset. For example, the decorative face may include an appearance of bricks and/or stones and/or wooden slats and/or the geometry may be arranged such that the layers of the decorative face 106 coincide with layers of the body 110 of the underlying block. Optionally, the geometry of the decorative face 106 is configured to match between blocks when the blocks are positioned at a fixed offset which corresponds to the offset of alignment elements (e.g. the slot and/or protrusion). In some embodiments, a decorative face will cover one or two sides of a block. For example, the decorative face may cover opposite lateral sides of the block. Alternatively or additionally, a decorative facing may cover all side of a block (for example, the block is configured for building a column and/or where each layer of the column is a single block). For example, a column layer block may have the form of a ring with a decorative outer facing on outside. In some embodiments, alignment elements will be on the inside of the ring. Alternatively or additionally, an alignment element may be on the outside of the ring. For example, for a decorative cut stone facing 106 the upward projecting protrusion 102 may break the linear boundary between the layers like a rough stone finish that may not have perfect horizontal layers. The cross section of a ring block (e.g. the body 110 thereof) may be arbitrary, for example square and/or circular and/or rectangular and/or oval.

In some embodiments, a self-aligning block is configured for including a reinforcing element. For example, a block may be designed such that positioning blocks at predetermined positions (e.g. stacking) and/or predetermined offset aligns an internal channel into which a reinforcement element (e.g. concrete and/or rebar and/or a prestressing element) may be inserted. For example, the reinforcement element may join between blocks and/or layers. For example, the reinforcement element may be longer than a parallel dimension of a block, for example, a rebar in a vertical reinforcement element and/or a vertical threaded rod of a prestress element may be longer than the height of a block. In some embodiments, the internal channel may serve as a mold into which the concrete of a reinforcement element is cast. For example, rebar may be positioned into the channel and/or concrete may be poured into the channel and/or the concrete may cure to for a reinforcement.

Figure 2:
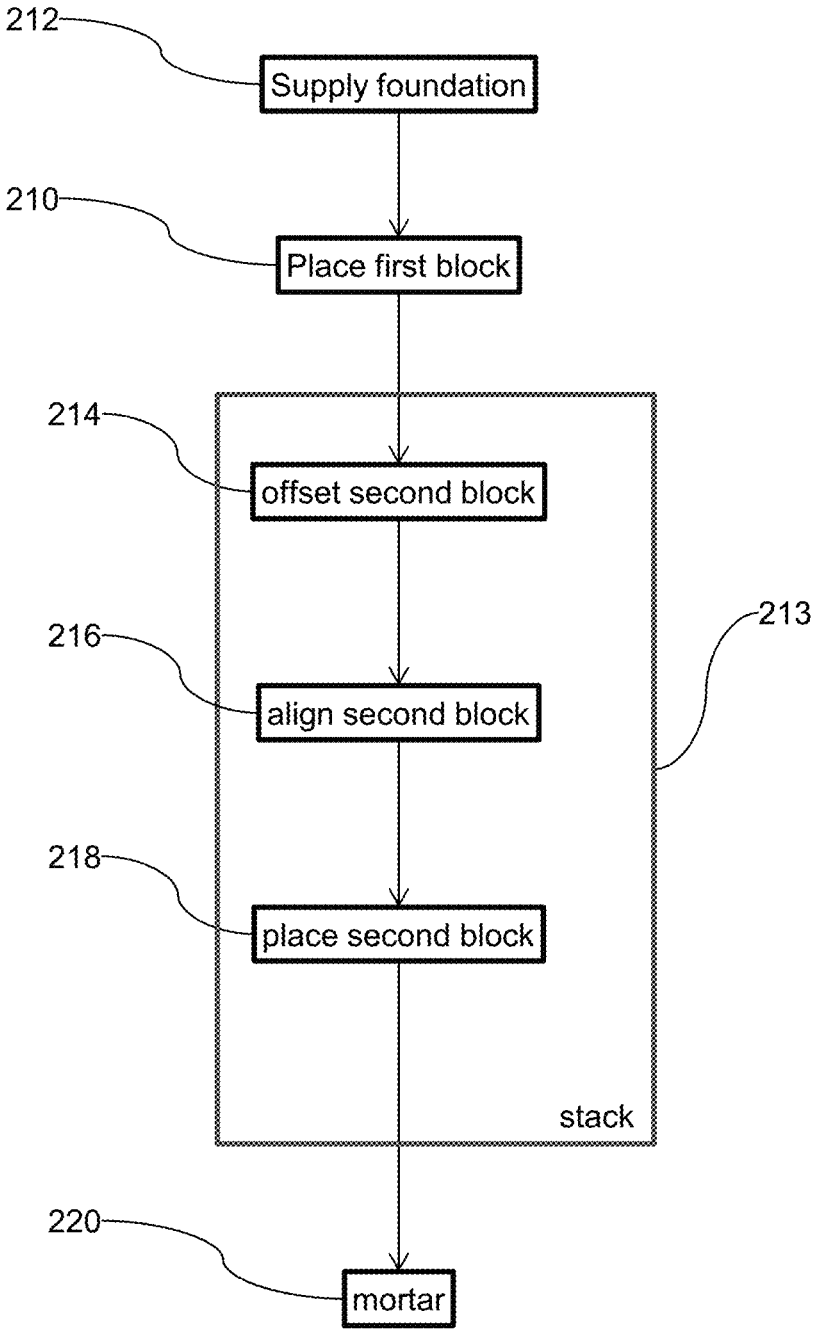
FIG. 2 is a flowchart illustration of building a structure using a decorative block in accordance with an embodiment of the current invention.

FIG. 2 is a flowchart illustration of building a structure (for example a column) using a decorative block in accordance with an embodiment of the current invention. In some embodiments, a foundation may be supplied 212. For example, supplying 212 the foundation may include positioning a prefabricated part and/or building a foundation in place. Optionally, a first block is placed 210 onto and/or secured onto the foundation. In some embodiments, a second block is stacked 213 onto the first block and/or a third block is stacked 213 onto the second block and so on. Optionally, the blocks may all be similar (e.g. have the same geometry). In some embodiments, stacking 213 an upper block onto a lower one includes offsetting 214 the upper block with respect to the lower block. Optionally, the upper and lower blocks may be aligned 216. For example, there may be interlinking alignment elements (e.g. a block may include protrusions and/or slots that are aligned at a predetermined offset between an upper block and a lower block). Optionally, the upper block is then placed 218 on the lower block in the predetermined offset. In some embodiments, joints may be mortared 220. Alternatively or additionally, the assembly maybe mortarless.

In some embodiments, a foundation for a structure may be a simple platform onto which a brick is placed and/or adhered. For example, a platform may consist of a flat concrete surface (for example formed by pouring concrete into a trench).

Alternatively or additionally, a foundation may include additional alignment and/or connection and/or reinforcement elements. For example, the foundation may include protruding rebar that may pass through a channel of the structure to be filled in with concrete. For example, a foundation may include protruding prestressing elements (for example a threaded metal rod and/or a cable with a threaded end piece).

Optionally, the reinforcement and/or connection and/or alignment elements may be built into a prefabricated base.

In some embodiments, a self-aligning block may also include a calibration feature. For example, a feature as described in connection to FIG. 1*a* above may be included in a block having an alignment element as described if FIG. 1B and herein.

For example, an upper block may be placed 218 on the calibration feature of the lower block. For example, a block may include a ridge on a top face thereof when blocks are stacked (e.g. while building a structure). For example, the ridge of a lower block may be part of a support surface upon which a bottom of upper block is supported when the upper block is stacked 213 on the lower block.

In some embodiments, a block may be placed 218 first and afterwards mortar 220 used to fill space between faces of blocks. Alternatively or additionally, mortar 220 may be laid before placing 218 the block. In some embodiments, mortar 220 will be place and then the block will be placed 218 until it contacts the calibration feature of an adjacent block. Optionally the ridge is trimmed so that a top of the ridge is parallel to the bottom of the block. For example, the block may have a flat bottom.

In some embodiments, offsetting 214 will include rotating a block with respect to an adjacent block. For example, the blocks may be configured to fit together when they are stacked one directly on top of the other with a relative rotation. For example, the relative rotation may be 90 degrees and/or 180 degrees and/or between 0 to 90 degrees and/or 90 to 180 degrees. Optionally, the relative rotation may be at an angle of symmetry of the block. For example, a square block may link at relative rotation offset of 90 and/or 180 degrees. For example, a rectangular block may fit to another block at a rotational offset of 180 degrees. For example, a hexagonal block may fit to another block at a rotational offset of 60 degrees and/or a multiple thereof. For example, a round block may fit to another block at a rotational offset of any angle.

In some embodiments, the offsetting 214 of a block with respect to an adjacent block will result in aligning decorative faces of the adjacent blocks. For example, the blocks may have a decorative simulated brick facing. When a lower block supports a non-offset similar second block, the joints of the simulated bricks of the two blocks would line up which may not be aesthetic and/or may not appear like a real brick wall (e.g. where successive rows of bricks are staggered). Optionally, the block is configured such that the same offset that aligns the alignment features also aligns the facings of the two bricks (e.g. that the joints of adjacent rows of the simulated bricks on adjacent blocks will be staggered). For example, in some structures (for example a pillar) each block may form a layer of the structure. The structure may be built by stacking 213 a predetermined plurality of blocks directly on top of one another on a foundation. Optionally, a reinforcement may be added. In some embodiments, the predetermined number of bricks and/or prefabricated base and/or a reinforcing element may be packaged in a kit. For example, self aligning and/or pre-calibrated blocks may facilitate do-it-yourself building of a concrete block structure.

Figure 3:
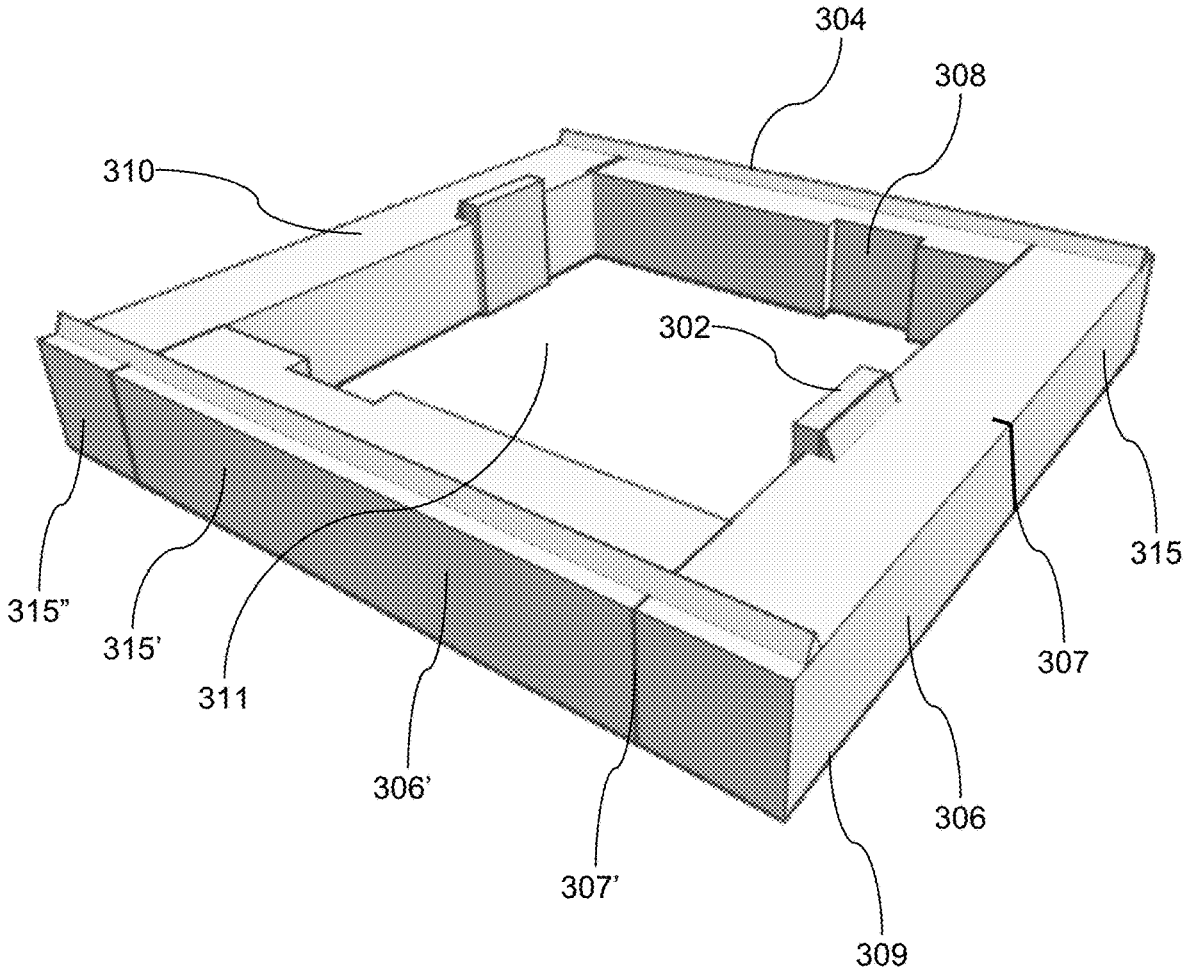
FIG. 3 is a perspective view of a square decorative block in accordance with an embodiment of the current invention.

FIG. 3 is a perspective view of a square decorative block in accordance with an embodiment of the current invention. Optionally the block includes a body 310 having flat bottom surface 309 and a hollow interior 311. Optionally, the block includes interlinking alignment features, for example, an alignment slot 308 and/or a protrusion 302. For example, slot 308 passes vertically through the body and/or is sized to fit alignment protrusion 302. Optionally, the block further includes a calibration feature 304. For example, feature 304 may include a ridge projecting above a top face of the body 310 of the block. Optionally, calibration feature 304 serves as a support surface for supporting a block resting on the block. Optionally, the block includes decorative faces 306, 306' on four sides of the block. For example, the decorative faces 306 and 306' may include simulated bricks 315 punctuated by simulated joints 307. Optionally the order of the brick 315 faces and joints 307 are staggered on adjacent sides. For example, on face 306, a joint is located at the center of the side surrounded by two complete brick faces 315. In contrast, face 306' for example there is a central brick 315' surrounded by joints 307' and half bricks 315". Optionally, when sequential blocks 300 are stacked at a 90 degree rotational offset the central joint 307 is aligned directly under a central brick 315' of the adjacent block.

Figure 4:
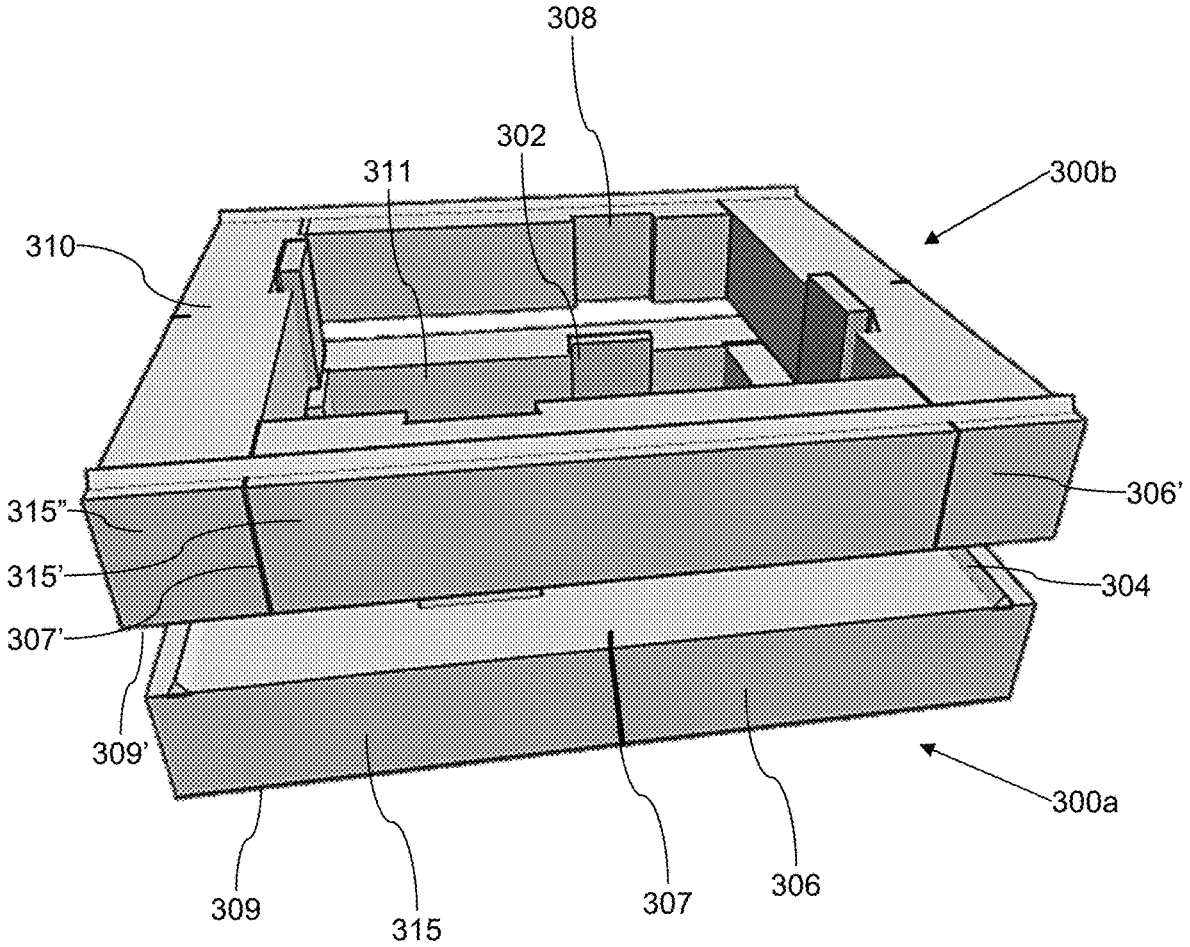
FIG. 4 is a perspective view of building a square column using decorative blocks in accordance with an embodiment of the current invention.

FIG. 4 is a perspective view of building a square column using decorative blocks in accordance with an embodiment of the current invention. For example, an upper block 300*b* is shown being stacked onto a similar lower block 300*a*. Optionally, the upper block 300*b* is rotated 90 degrees with respect to block 300*a* such that alignment features interlink aligning block 300*a* to block 300*b*. For example, a protrusion 302 of block 300*a* fit into and/or interlink with slot 308 of block 300*b*. Optionally, the 90-degree rotation also causes face 306' of block 300*b* to sit directly above face 306 of block 300*a*. The faces 306, 306' are configured such that at the 90-degree rotation simulated joint 307 is positioned directly under the center of simulated brick 315' and/or simulated joints 307' are positioned directly above the center of simulated bricks 315. Thus, the simulated bricks 315, 315' are aligned in staggered rows giving an aesthetically pleasing appearance of a real brick wall.

In some embodiments, a bottom surface 309' an upper block 300*b* sits on a support surface of a lower block 300*a*. For example, the support surface may include a calibration feature 304 which is calibrated to be parallel to a bottom surface 309 of the block 300*a* and/or at a predetermined height from the bottom surface 309 of that brick 300*a*. Thus, the height of block 300*b* and/or the relative positions of blocks 300*a* and 300*b* are kept at a desired alignment. Optionally, on all four sides of blocks 300*a* and 300*b*, decorative faces are aligned. Optionally, a stacked set of blocks 300*a*, 300*b* forms a decorative pillar.

In some embodiments, hollow portions 311 of multiple blocks 300*a*, 300*b* are aligned to form a shared channel. For example, a reinforcing element may be positioned inside the hollow 311. For example, rebar may pass through the hollow across both bricks and/or concrete may be poured into the hollow around the rebar creating an internal concrete pillar reinforcing the blocks 300*a* and 300*b*.

Figure 5:
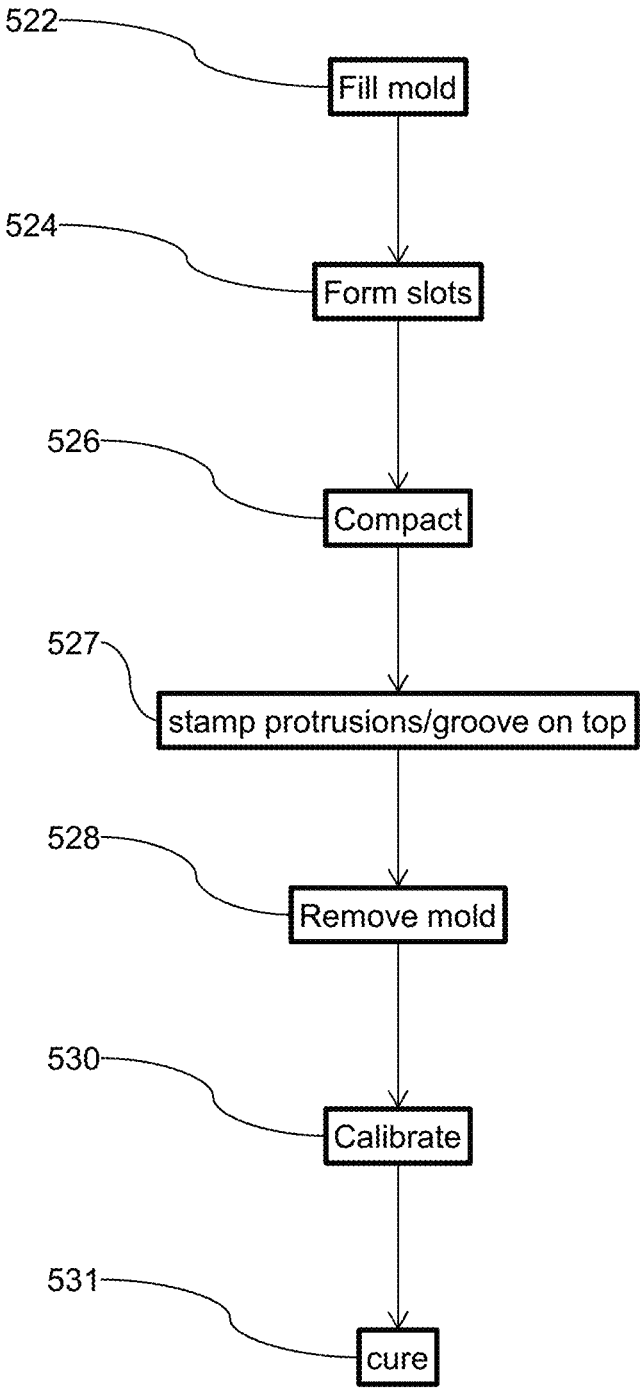
FIG. 5 is a flow chart illustration of manufacturing a decorative block in accordance with an embodiment of the current invention.

FIG. 5 is a flow chart illustration of manufacturing a building block in accordance with an embodiment of the current invention. In some embodiments, concrete (e.g. with various mixtures of sand, clay, coal, cement, gravel, cinder etc.) is poured to fill 522 a mold. In some embodiments the shape of the mold forms 524 one or more vertical slots through the block. Alternatively or additionally, the shape of the mold forms 524 one or more vertical slots and/or outward protruding vertical ridges on an outer side of the block. Optionally, the concrete is compacted 526 from above, for example with a mold head. Optionally, vertical protrusions and/or grooves are stamped 527 onto the top of the wet concrete with the mold head (for example due to the shape of the mold head e.g. with a groove in the bottom surface of the mold head). Once the block is formed, the mold is optionally removed 528. In some embodiments the mold is removed 528 vertically. For example, features formed in the block by the mold may be formed without vertical undercuts, facilitating removal 528 of the mold. For example, slots in the block made by the mold may be at least as wide at the top of the block as they are at the bottom of the block.

In some embodiments, the block is calibrated 530 after molding. For example, calibration may include trimming a calibration feature. Optionally, the calibration feature may include a protrusion (e.g. in the side and/or top of the block). Optionally, the block may be trimmed before curing 531, for example by shaving and/or squashing the calibration feature while it is soft before curing. Alternatively or additionally, the block (e.g. the calibration feature) may be trimmed after curing (for example by grinding). In some embodiments the calibration feature is trimmed to be parallel to an opposing side of the block. For example, a calibration feature on top of a block may be trimmed to be parallel to a flat bottom of the block. Optionally the calibration feature is trimmed to a tolerance of less than 0.5 mm and/or less than 2 mm and/or between 2 to 6 mm and/or between 6 to 15 mm.

In some embodiments, a mold includes an outer mold box and/or one or more mold liners. The liners optionally determine the outer shape of the block and the inner shape of the block cavities. For example, the mold liners may be configured to form slots in the block. In some embodiments, as many as 15 blocks may be molded at one time. After the molds are filled 522, the concrete is optionally compacted 526 by an upper mold head coming down on the mold cavities. Optionally, compaction 526 may be due to the weight of the mold head and/or supplemented by air or hydraulic pressure cylinders acting on the mold head. Optionally vibration may be used enhance compaction 526. For example, one or more short burst of mechanical vibration may further aid compaction 526. In some embodiments, the compacted blocks are removed 528 from the molds by being pushed down and/or out of the molds. In some embodiments, the blocks are removed 528 onto a flat pallet (for example made of steel). Optionally, the pallet and/or blocks are pushed out of the machine and onto a chain conveyor.

In some embodiments, after removing the blocks from the mold, the blocks are calibrated. For example, a trimmer may trim a calibration feature while the blocks are on the pallet (for example the trimmer passing across the blocks). Alternatively or additionally, the blocks may be trimmed while still in the molds (e.g. after lifting the molding head). Alternatively or additionally, the blocks may be trimmed after they have been pushed out of the molds onto a conveyer. For example, the blocks may pass along the conveyer through a trimmer.

in some embodiments, the block is configured to facilitate the trimming. For example, calibration features may be aligned parallel to movement of the block. Additionally or alternatively, calibration features may be offset from protruding alignment features perpendicular to the direction of movement of the block with respect to the trimmer such that the trimmer crosses the block without being obstructed by the alignment protrusions. Alternatively or additionally, the conveyer may bring the blocks to a trimming machine which trims the blocks and/or outputs them back to a conveyer. Optionally, the blocks are cleaned. For example, the blocks may pass on the conveyer past a rotating brush which removes loose material from the top of the blocks.

In some embodiments, blocks may be molded using a conventional molding machine. Optionally the changes in molding compared to conventional blocks are achieved by adjustments in the mold insert and/or the molding head. Additionally or alternatively, the production of the blocks may include an additional step of trimming. Alternatively or additionally, calibration 530 (e.g. trimming) may be done off line.

Figure 6:
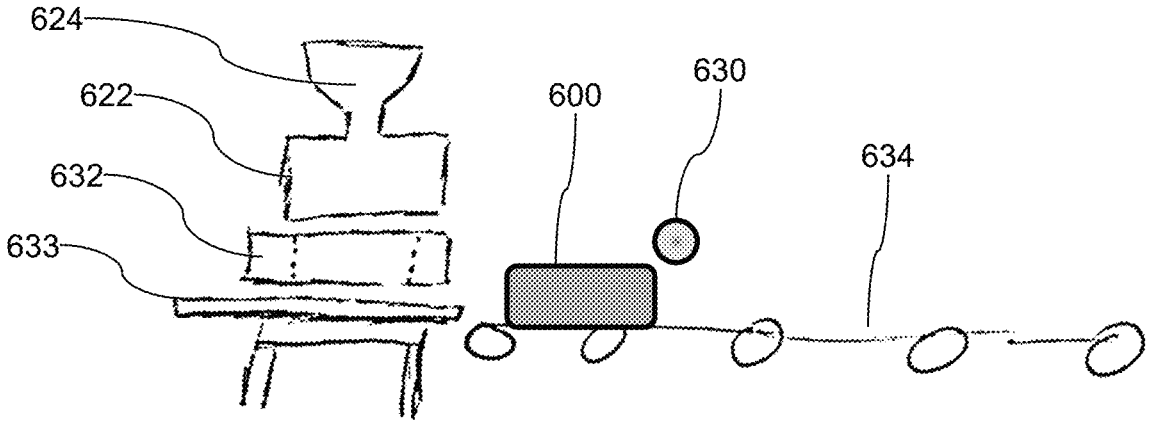
FIG. 6 is a schematic illustration of a system for manufacturing a decorative block in accordance with an embodiment of the current invention.

FIG. 6 is a schematic illustration of a system for manufacturing a decorative block 600 in accordance with an embodiment of the current invention (in the exemplary illustration block 600 is shown on a conveyer 624 after molding and/or before calibration). The machine optionally, includes a hopper for receiving wet concrete. For example, the concrete may include 0-slump concrete. In some embodiments, the wet concrete is placed into a mold 632. Optionally the system further includes a mold head 622. For example, when the concrete is in the mold 632, the mold head 622 may be lowered onto the block 600 and/or compact the block 600 against a pallet 633. For example, a bottom surface of the molding head 622 may be configured to form an alignment protrusion and/or a calibration feature on the top of the block 600. Optionally, the pallet 633 and/or the bottom of the block 600 is flat. In some embodiments, the block is removed from an open bottom of the mold 633 and/or deposited on the pallet 633 and/or moved to conveyer 634. Alternatively or additionally, the block 600 is deposited straight from the mold onto a floor (for example, by an egg layer block machine. Alternatively or additionally, the block 600 is deposited straight from the mold 624 onto the conveyer 634. Additionally or alternatively, the mold head 622 is raised away from the block. In some embodiments, while the newly molded block 600 is on the conveyer 634, it passes under a trimmer 630. For example, the trimmer may calibrate a block 600 by trimming a calibration feature to give the block 600 a desired dimension and/or tolerance.

Figure 7A:
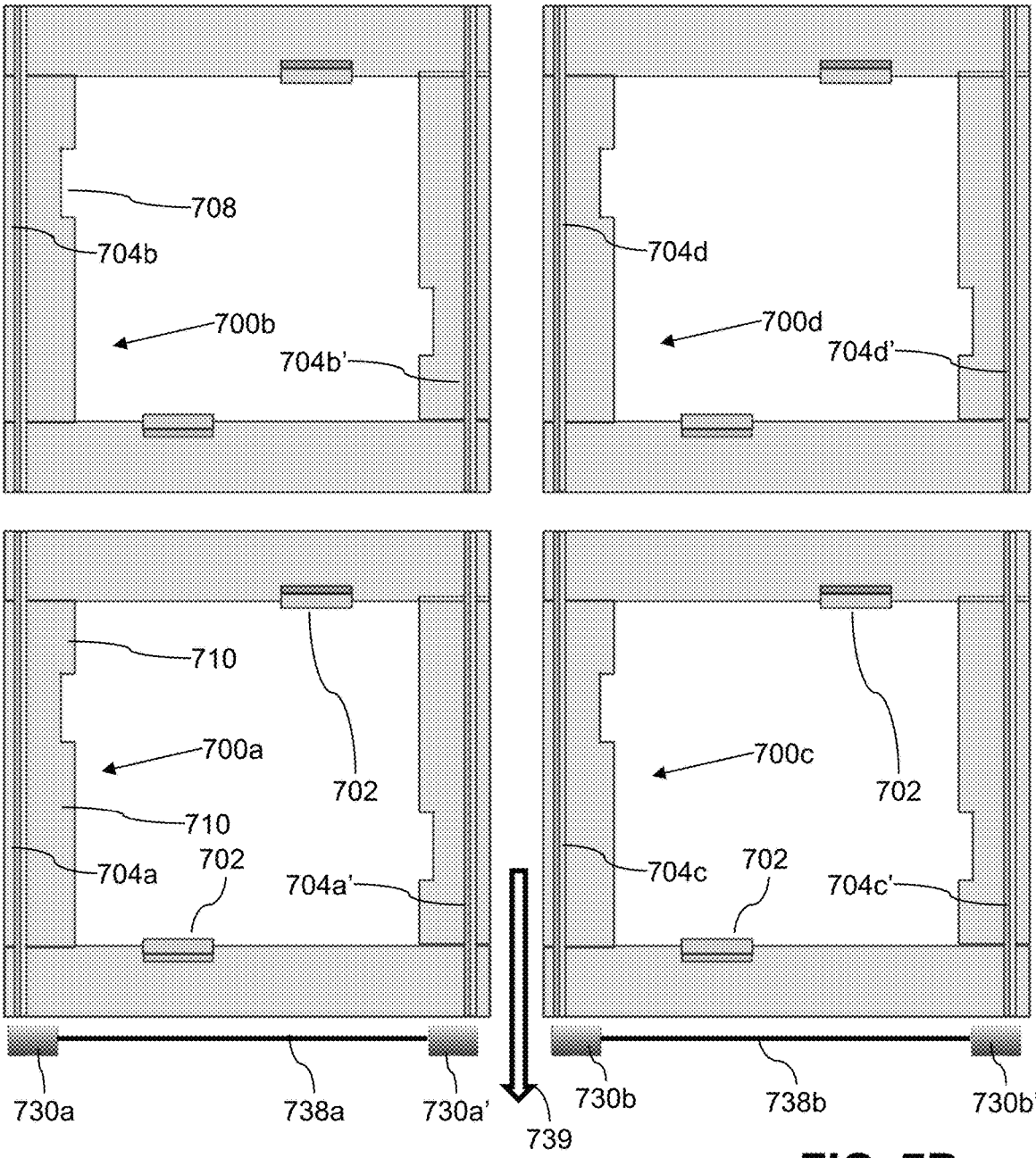
FIG. 7A is an overhead view of calibrating a decorative block in accordance with an embodiment of the current invention.

FIG. 7A is an overhead view of calibrating a decorative block in accordance with an embodiment of the current invention. For example, four blocks 700*a*, 700*b*, 700*c*, 700*d* are transported away from a molding machine in a direction of movement 739. Optionally, one or more calibration features 704*a*, 704*a*', 704*b*, 704*b*', 704*c*, 704*c*', 704*d*, 704*d*' are lined up along the direction of movement 739, such that as the blocks 700*a*, 700*b*, 700*c*, 700*d* pass along the conveyer, the calibration features 704*a*, 704*a*', 704*b*, 704*b*', 704*c*, 704*c*', 704*d*, 704*d*' pass under one or more trimmers 730*a*, 730*a*', 730*b*, 730*b*'. For example, trimmers 730*a*, 730*a*', 730*b*, 730*b*' may include a grinding wheel mounted on a rotating axle 738*a*, 738*b*. Optionally, the blocks 700*a*, 700*b*, 700*c*, 700*d* are configured and positioned on the conveyer such that protruding alignment features 702 are not transported into the and/or do not interfere with trimmers 730*a*, 730*a*', 730*b*, 730*b*'. For example, protrusions 702 are offset from calibration features 704*a*, 704*a*', 704*b*, 704*b*', 704*c*, 704*c*', 704*d*, 704*d*' such that trimmers 730*a*, 730*a*', 730*b*, 730*b*' are aligned with and/or intercept calibration features 704*a*, 704*a*', 704*b*, 704*b*', 704*c*, 704*c*', 704*d*, 704*d*' but not protruding alignment features 702. For example, trimmer 730*a* is positioned to trim calibration features 704*a* and 704*b*. For example, trimmer 730*a*' is positioned to trim calibration features 704*a*' and 704*b*'. For example, trimmer 730*b* is positioned to trim calibration features 704*c* and 704*d*. For example, trimmer 730*b*' is positioned to trim calibration features 704*c*' and 704*d*'. Also shown are exemplary grooves 708 in a body 710 and a decorative faces 706 of blocks 700*a*, 700*b*, 700*c* and 700*d*.

Figure 7B:
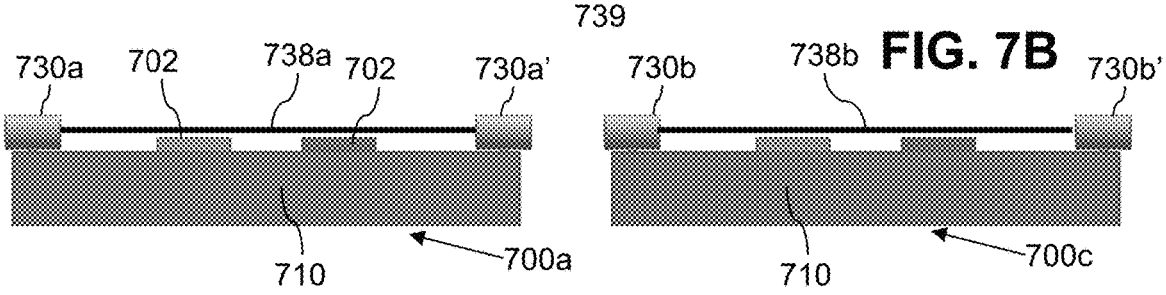
FIG. 7B is a front view of calibrating a decorative block in accordance with an embodiment of the current invention.

FIG. 7B is a front view of calibrating a decorative block in accordance with an embodiment of the current invention. In some embodiments, trimmers 730*a*, 730*a*', 730*b*, 730*b*' are aligned with and/or intercept calibration features 704*a*, 704*a*', 704*b*, 704*b*', 704*c*, 704*c*', 704*d*, 704*d*' while alignment features 702 bypass the trimmers 730*a*, 730*a*', 730*b*, 730*b*', for example passing under axles 738*a*, 738*b*. Optionally the body 710 of the blocks 700*a*, 700*b*, 700*c*, 700*d* passes under the trimmers 730*a*, 730*a*', 730*b*, 730*b*' and axles 738*a*, 738*b*.

Figure 7C:
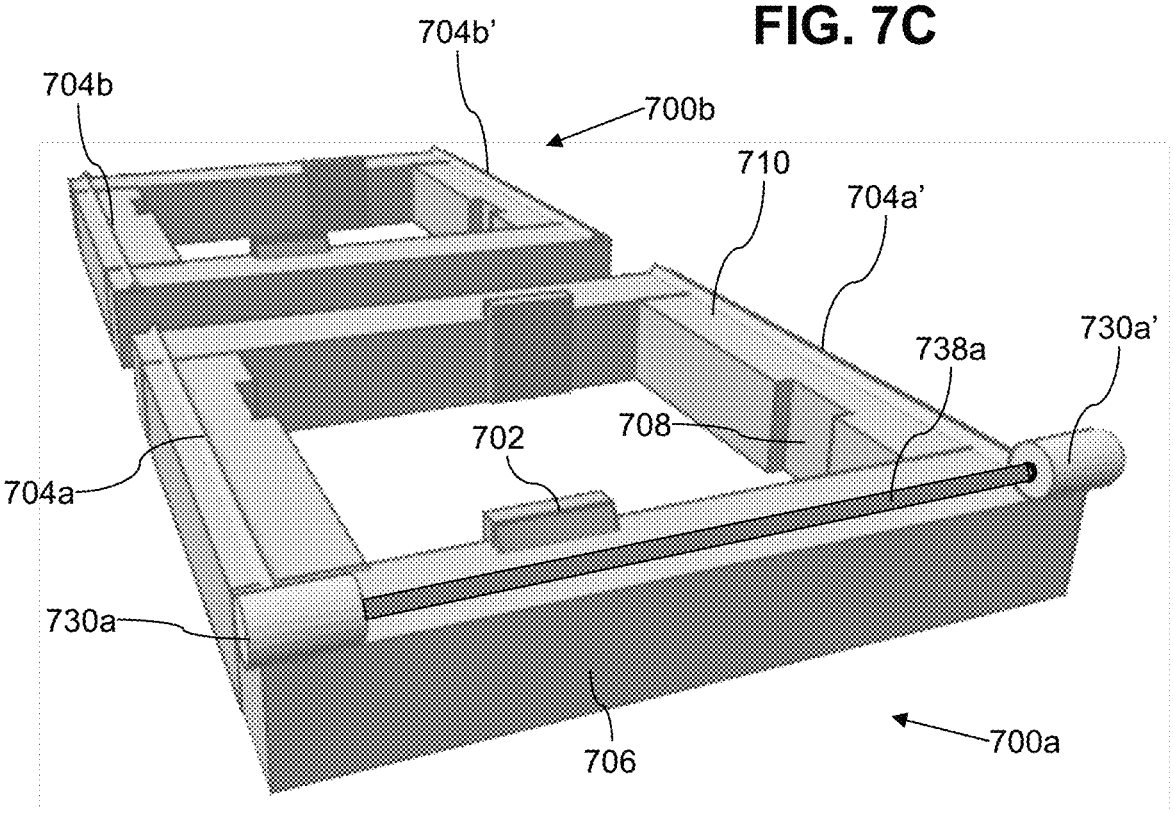
FIG. 7C is a perspective view of calibrating a decorative block in accordance with an embodiment of the current invention.

FIG. 7C is a perspective view of calibrating a decorative block in accordance with an embodiment of the current invention.

Figure 8:
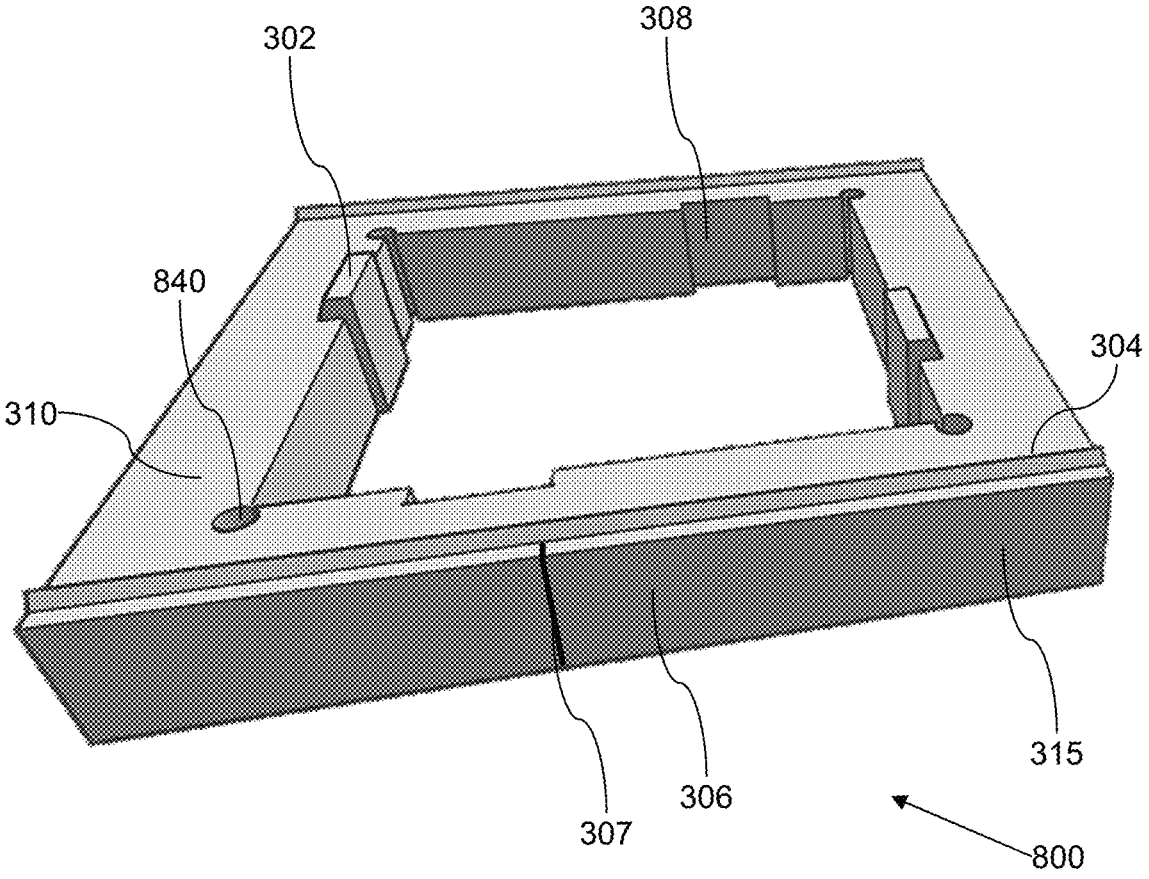
FIG. 8 is a perspective view of a square decorative block with reinforcing channels in accordance with an embodiment of the current invention.

FIG. 8 is a perspective view of a square decorative block with reinforcing channels in accordance with an embodiment of the current invention. In some embodiment, a block may include features to facilitate reinforcement of a structure. For example, block 800 includes channels 840. Channels 840 are optionally positioned such that when a structure is built by stacking a plurality of blocks 800 one on the other at a predetermined offset (e.g. piling directly on top of each other at an angular offset of 90 degrees) the channels 840 of adjacent blocks will line up. Optionally, at the predetermined offset, alignment features 302 and 308 may interlink and/or fix the alignment. Optionally, at the predetermined offset, alignment features 302 and 308 may interlink and/or fix the alignment a decorative face 306 may be aligned across subsequent blocks (e.g. joints 307 of one block will align with simulated bricks 315 of a subsequent block). Optionally, channels 840 of the stack of blocks are aligned such that a reinforcing element (e.g. rebar and reinforced concrete and/or a prestressing element such as a threated rod) passes through the combined channels to reinforce the entire structure and/or a portion of the structure including multiple blocks.

Figure 9:
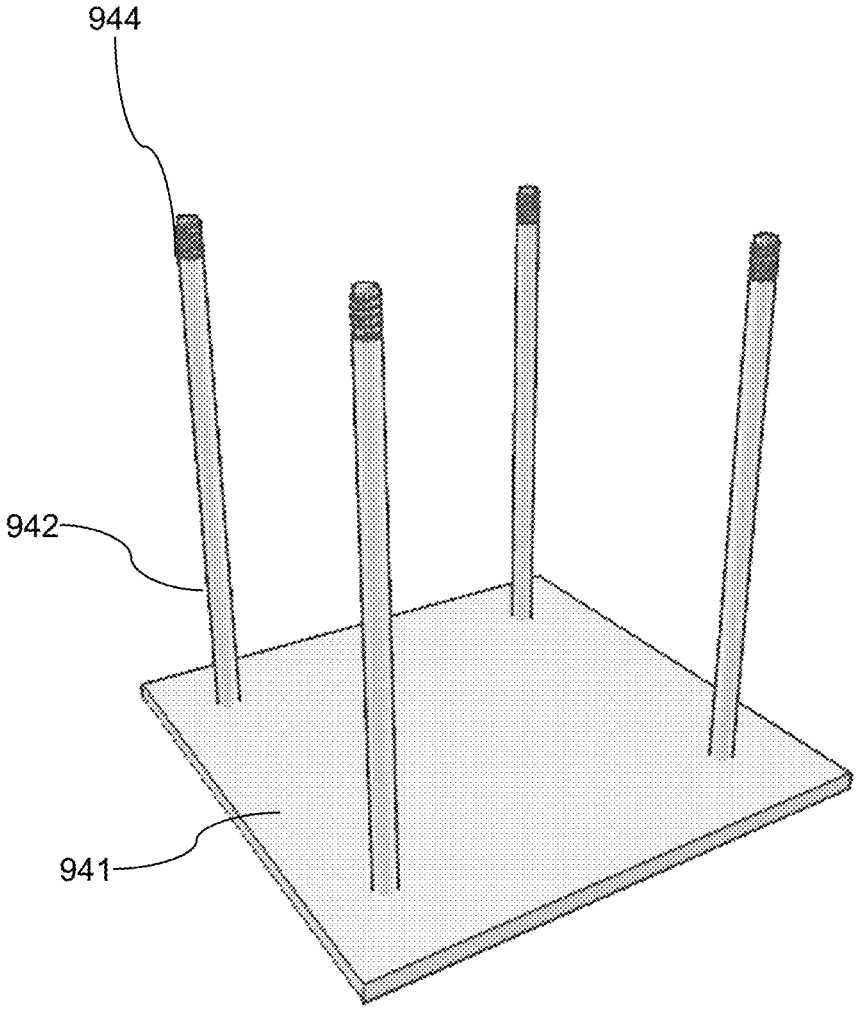
FIG. 9 is a perspective view of a base for a square decorative block with reinforcing channels in accordance with an embodiment of the current invention.

FIG. 9 is a perspective view of a base for a square decorative block with reinforcing channels in accordance with an embodiment of the current invention. In some embodiments, a foundation for a structure includes a prefabricated base. For example, a base may include a bottom plate 941 that rests on a surface (for example, the plate may be placed on a hard surface and/or plate 941 may be incorporated into a cement slab. Optionally plate 941 holds four reinforcing elements 942. For example, reinforcing elements 942 may include a steel rod. Optionally, a plurality of blocks 800 are stacked on the base with elements 942 passing through channels 840. For example, the blocks 800 may be stacked one directly on top of another. Optionally adjacent blocks may be offset at 90 degree angles such alignment element 302 and 308 interlink. In some embodiments, reinforcing elements may serve to prestress a structure. For example, reinforcing elements may include a screw thread 944 for tightening a nut onto a structure to stress it during curing. Optionally, concrete may be filled into channels 840 around elements 942 with and/or without prestressing.

Figure 10A:
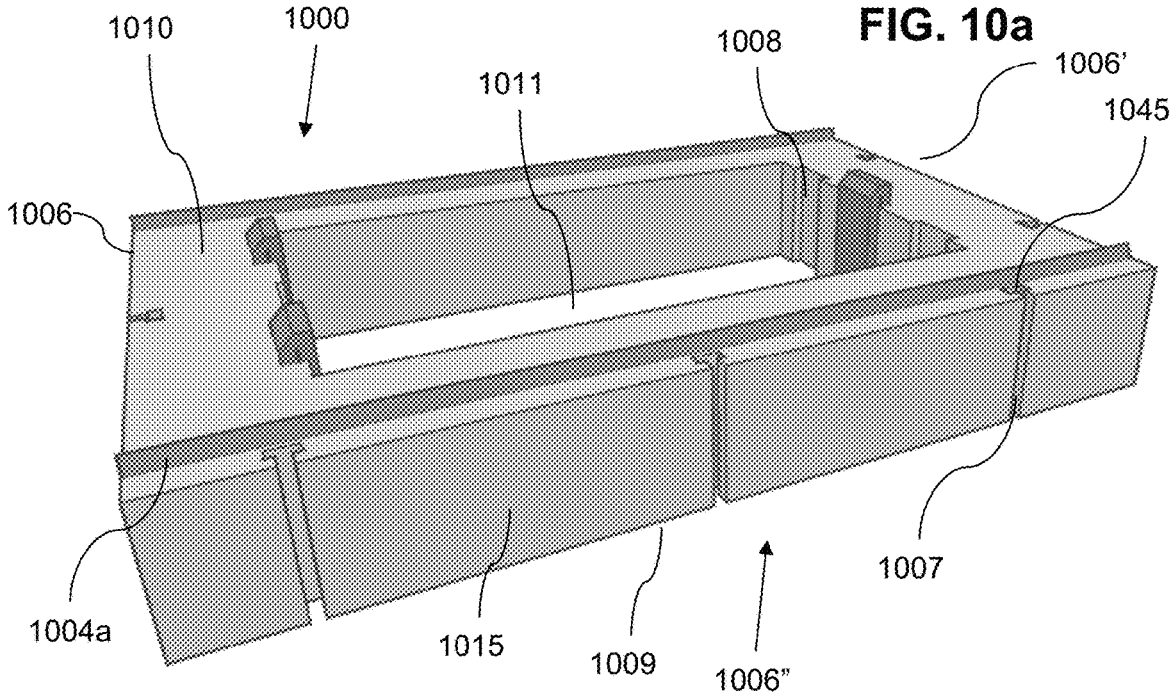
FIG. 10A is a perspective view of a rectangular decorative block in accordance with an embodiment of the current invention.
Figure 10B:
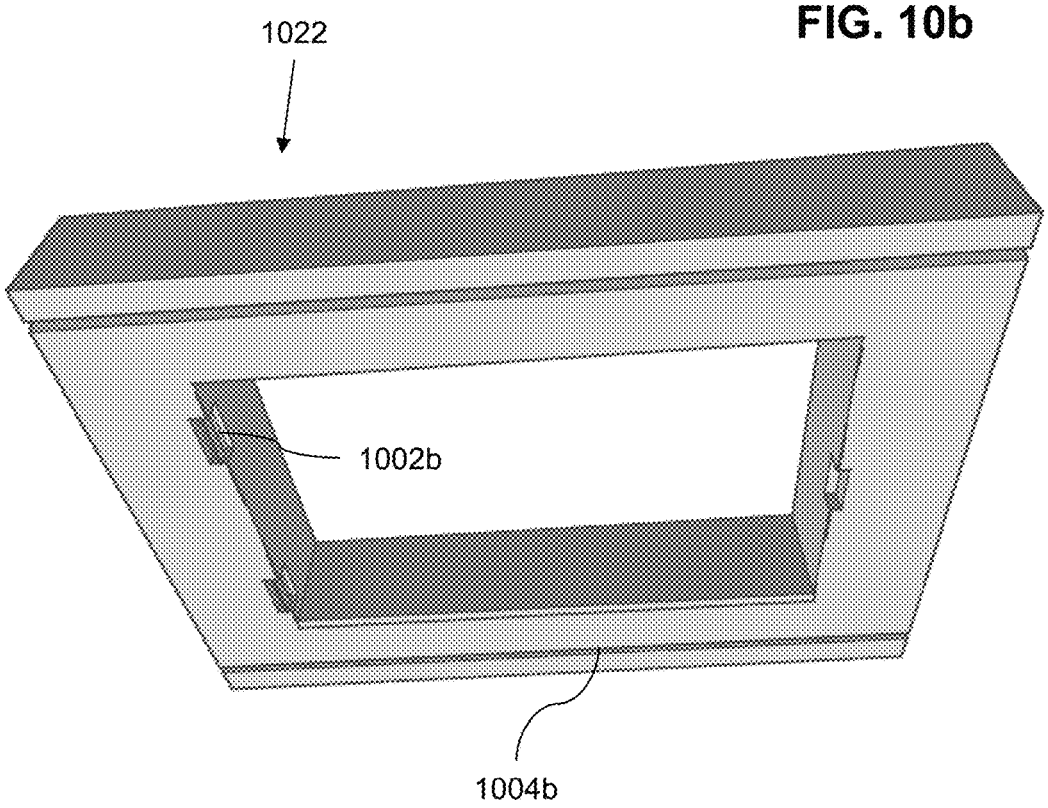
FIG. 10B is a perspective view of an upper mold head for a rectangular decorative block in accordance with an embodiment of the current invention.

FIG. 10A is a perspective view of a rectangular block 1000 in accordance with an embodiment of the current invention. Optionally the block 1000 includes a body 1010 having flat bottom surface 1009 and a hollow interior 1011. Optionally, the block includes interlinking alignment features, for example, an alignment slot 1008 and/or a protrusion 1002. For example, slot 1008 passes vertically through the body and/or is sized to fit alignment protrusion 1002. Optionally, the block further includes a calibration feature 1004. For example, feature 1004 may include a ridge projecting above a top face of the body 1010 of the block. Optionally, calibration feature 1004 serves as a support surface for supporting a block resting on the block. Optionally, the block includes decorative faces 1006, 1006', 1006" on four sides of the block. For example, the decorative faces 1006 and 1006' may include simulated bricks 1015 punctuated by simulated joints 1007. Optionally the order of the brick 1015 faces and joints 1007 are staggered on adjacent sides. For example, on face 1006, a joint in located at the center of the side surrounded by two complete brick faces 1006. In contrast, face 1006' for example there is a central brick face surrounded by joints and half brick faces. Optionally, when sequential blocks 1000 are stacked at a 180 degree rotational offset the central joint 1007 is aligned directly under a central brick of face 1006' of the adjacent block. Optionally, simulated joints 1007 may have an internal widening 1045. For example, when a block structure is built without mortar, the light effect of the internal widening 1045 may give a pleasing effect like mortar. For example, when a block structure is built with mortar, internal widening 1045 may facilitate interlocking of the mortar with the block face 1006, FIG. 10B is a perspective view of a lower surface of an upper mold head for a block in accordance with an embodiment of the current invention. In some embodiments, portions of the lower surface of a mold head 1022 may be hollowed out to form upward protrusions of an upper face of a block. For example, mold head 1022 may be used to produce block 1000. For example, a long triangular groove 1004*b* in mold head 1022 may be used to produce calibration feature 1004*a* of block 1000. For example, a shorter deeper groove 1002*b* in mold head 1022 may be used to produce an alignment feature such as projection 1002*a*.

Figure 11:
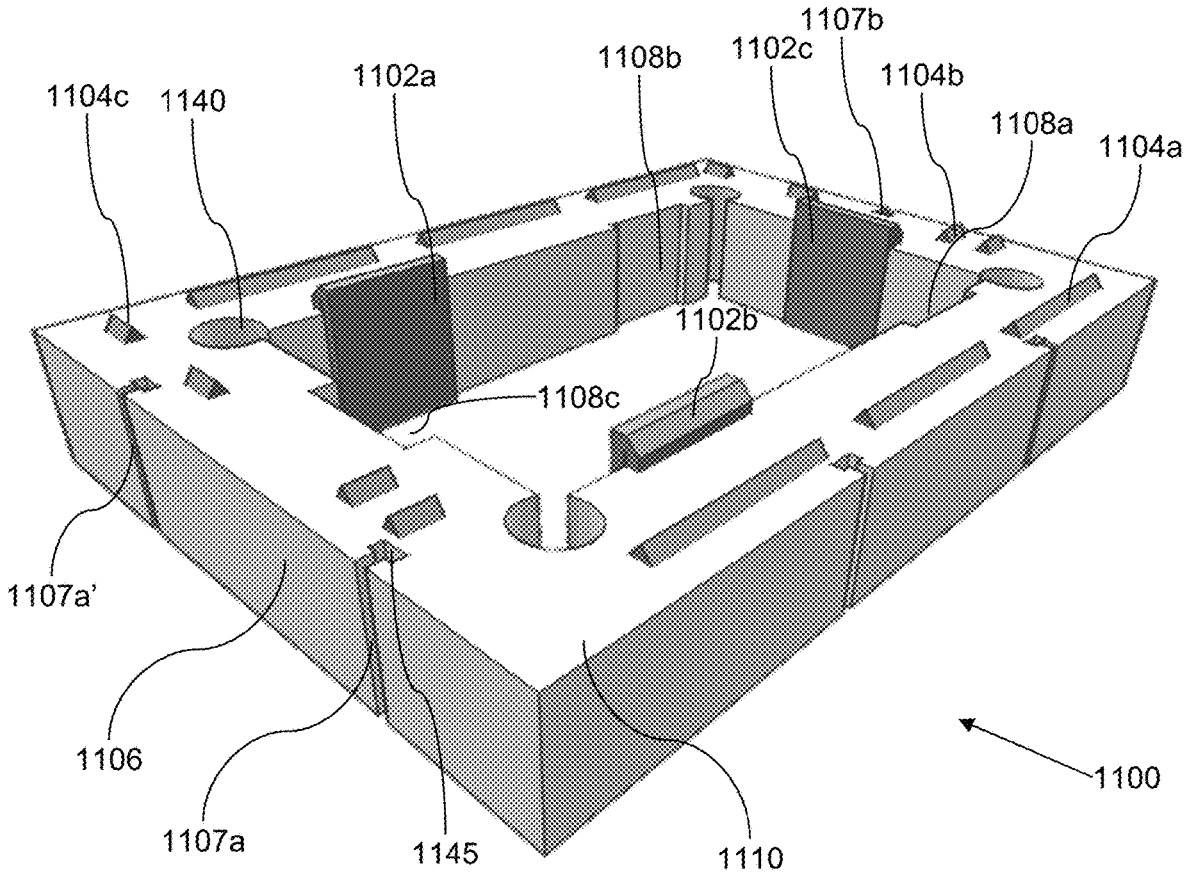
FIG. 11 is a perspective view of a rectangular decorative block with optional addition features in accordance with an embodiment of the current invention.

FIG. 11 is a perspective view of a rectangular decorative block 1100 with optional addition features in accordance with an embodiment of the current invention. For example, a plurality of rectangular blocks 1100 may offset and/or stacked on one another to produce a rectangular pillar. Optionally, rotating subsequent blocks 1100 to a 180-degree angle and/or stacking them one directly on top of the other may cause a protruding alignment feature (e.g. protrusion 1102*a*) on top of a lower block to fit into slot 1108*a* of a higher block. Optionally, rotating subsequent blocks 1100 to a 180-degree angle and/or stacking them one directly on top of the other may cause a protruding alignment feature (e.g. protrusions 1102*b*) on top of a lower block 1100 to fit into slot 1108*b* of a higher block. Optionally, rotating subsequent blocks 1100 to a 180-degree angle and/or stacking them one directly on top of the other may cause protruding alignment feature (e.g. protrusion 1102*c*) of a lower block 1100 to fit into slot 1108*c* of a higher block 1100. In some embodiments a longitudinal (e.g. parallel to an axis of movement of a block) upwardly projecting calibration feature 1104*a* may be positioned on a top surface of a body 1110 of block 1100. Optionally, the feature may be broken into multiple subfeatures (e.g. short aligned ridges). For example, the ridge and/or ridges may be laterally outside an area of alignment features such as protrusions 1102*a*, 1102*b*, 1102*c*. Alternatively or additionally, calibration features may have different geometries and/or positions. For example, a calibration feature to adjust the height of a block may include a ridge in various locations and/or orientations (for example as features 1104*b* and 1104*c*). Optionally, the features 1104*a*, 1104*b*, 1104*c* are positioned to make it easy to trim them (e.g. out of line with other protrusions 1102*a*, 1102*b*, 1102*c* in a movement direction of a block conveyer). Optionally, the block 1100 includes decorative faces 1106. For example, the blocks 1100 are stacked at a predetermined offset (e.g. 180 degrees) the faces 106 may produce an effect that appears like a brick wall. For example, a simulated joint 1107*b* on a first side of a lower block may be positioned below a middle point between two simulated joints 1107*a*, 1107*a*' in opposite side of an adjacent higher block 1100. For example, due to the 180 degree offset the side of the higher brick 1100 with simulated joints 1107*a*, 1107*a*' is stacked exactly over the side of the lower block 1100 with joint 1107*b*.

In some embodiments, a simulated joint 1107*a*, 1107*a*'1107*b* may include a internal widening 1145. For example, when a block structure is built without mortar, the light effect of the internal widening 1145 may give a pleasing effect like mortar. For example, when a block structure is built with mortar, internal widening 1145 may facilitate interlocking of the mortar with the block face 1106, In some embodiments, block 1100 includes channels 1140 that line up on subsequent stacked blocks 1100. For example, the channels 1140 may be used for a reinforcing element of a pillar produced by stacking blocks 1100.

Figure 12A:
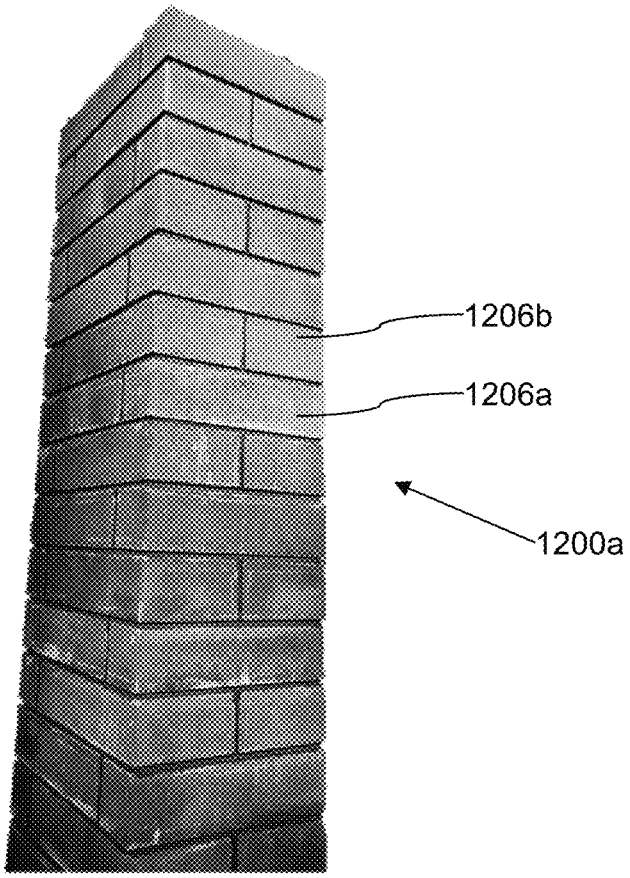
FIG. 12A is a perspective view of a rectangular pillar in accordance with an embodiment of the current invention.

FIG. 12A is a perspective view of a rectangular pillar 1200*a* in accordance with an embodiment of the current invention For example, pillar 1200*a* is constructed by stacking blocks having a side length equal to a single brick. For example, adjacent blocks stacked on each other are offset by 90 degrees. Each block optionally has two opposite faces 1206*a* with no simulated joint (e.g. simulating a whole brick) and two opposite faces 1206*b* having a simulated joint in the middle of the side. For example, when the faces 1206*b* with simulated joints in the middle are adjacent to the faces 1206*a* without joints such that when sequential blocks are offset 90 degrees adjacent faces 1206*a*, 1206*b* alternate between rows having a simulated joint and rows without a simulated joint.

Figure 12B:
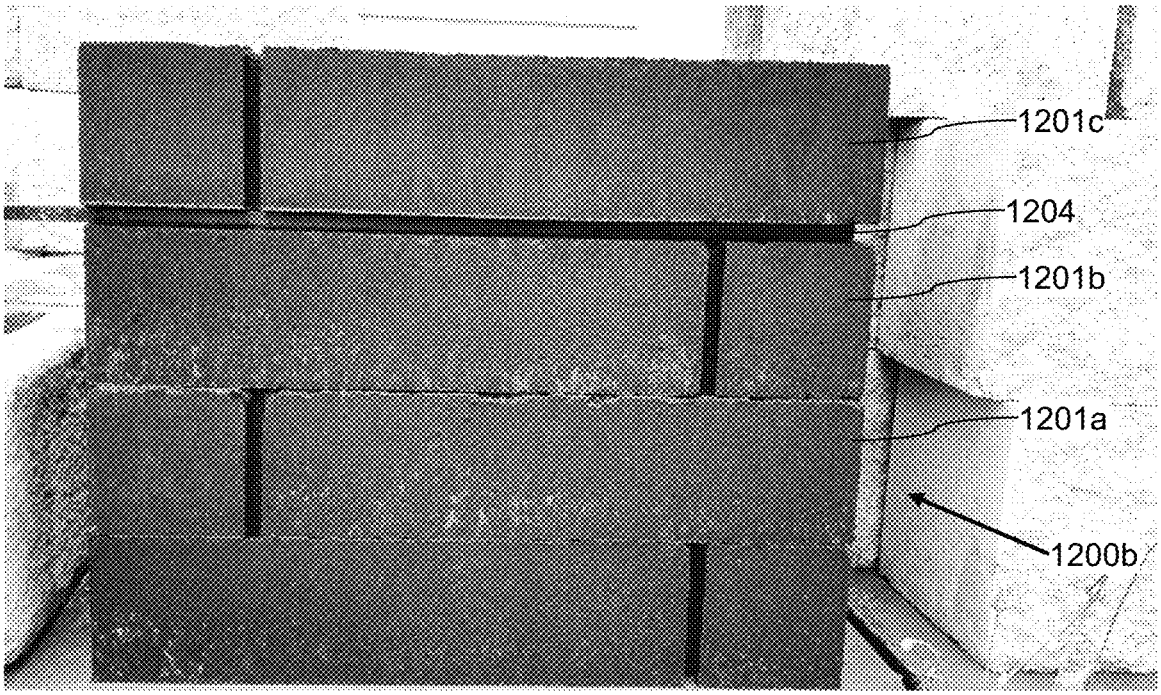
FIG. 12B is a perspective view of a rectangular mortarless pillar in accordance with an embodiment of the current invention.

FIG. 12B is a perspective view of a mortarless rectangular pillar in accordance with an embodiment of the current invention. For example, the blocks of pillar 1200*b* are stacked without mortar in between. Optionally, a block 1201*a* may be without a calibration ridge such that the block 1201*b* above it lies directly on the body of the lower block 1201*a*. Alternatively or additionally, a block 1201*b* may include a calibration ridge 1204 on top separating it from the block 1201*c* above it.

Figure 12C:
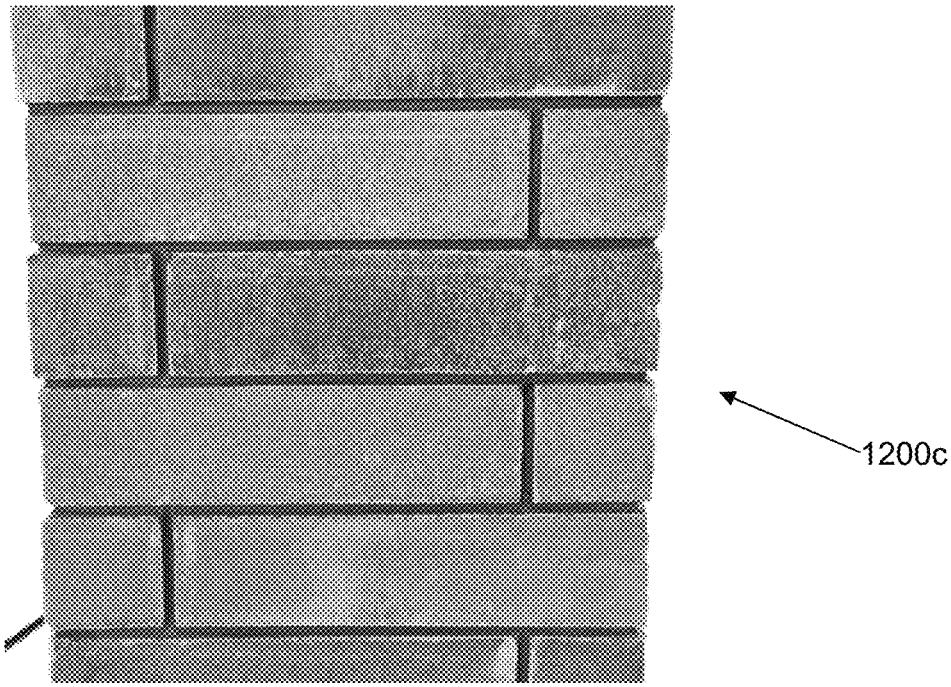
FIG. 12C is a perspective view of a rectangular pillar in accordance with an embodiment of the current invention.

FIG. 12C is a perspective view of a rectangular pillar of in accordance with an embodiment of the current invention. Optionally, mortar separates between block layers in pillar 1200*c*.

Figure 13:
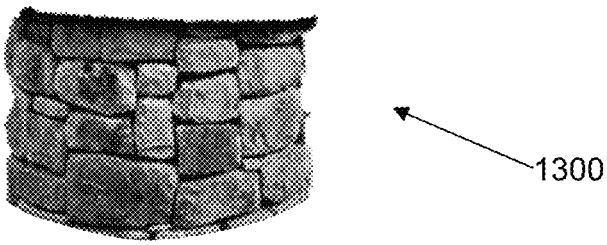
FIG. 13 is a perspective view of a round pillar in accordance with an embodiment of the current invention.
Figure 14:
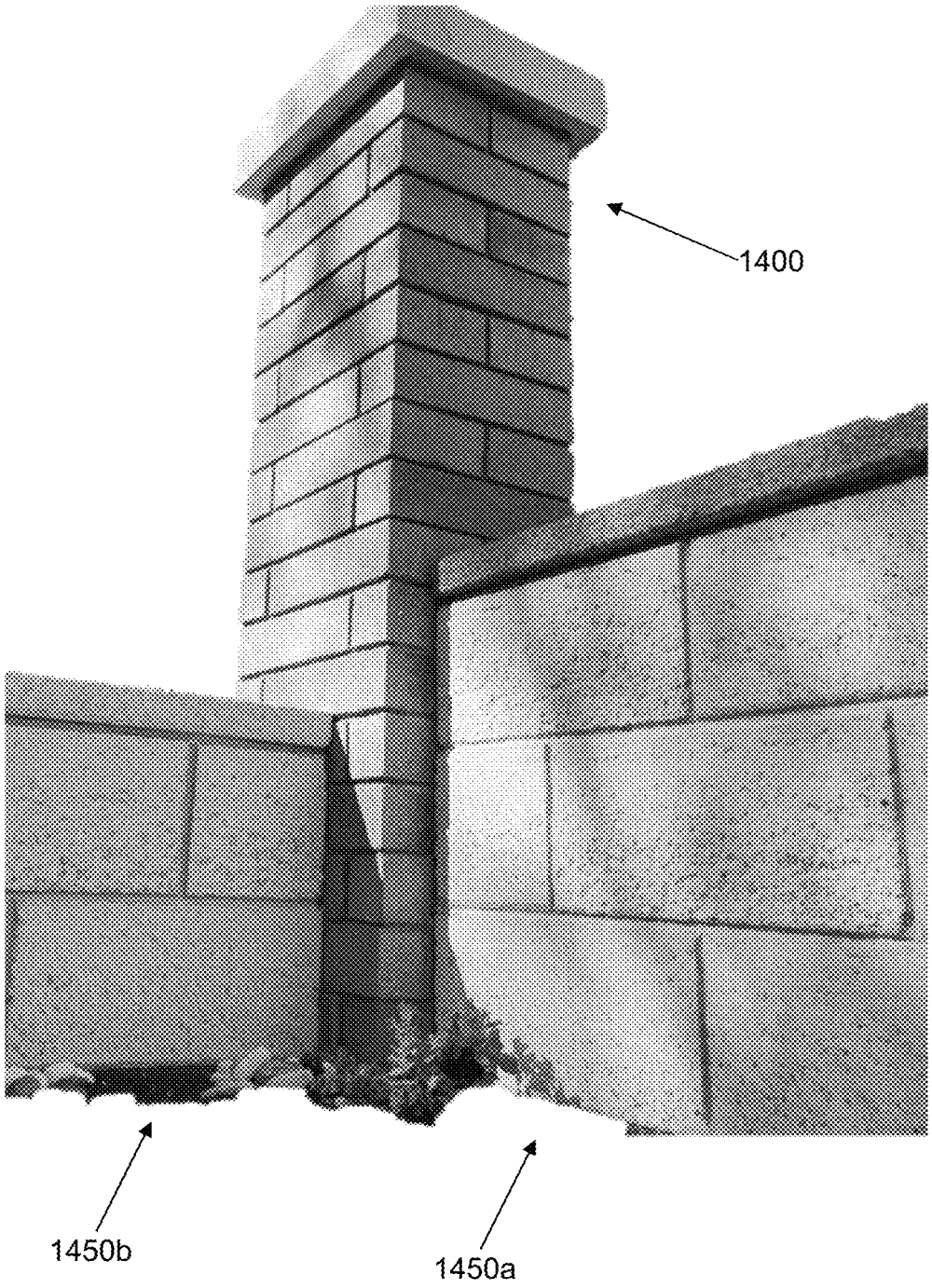
FIG. 14 is a perspective view of a rectangular pillar at the corner of two wall in accordance with an embodiment of the current invention.

FIG. 13 is a perspective view of a round pillar in accordance with an embodiment of the current invention; and FIG. 14 is a perspective view of a rectangular pillar at the corner of two wall in accordance with an embodiment of the current invention.

It is expected that during the life of a patent maturing from this application many relevant building technologies and/or materials will be developed and the scope of the terms is intended to include all such new technologies a priori. As used herein the term "about" refers to ±10%.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween. When multiple ranges are listed for a single variable, a combination of the ranges is also included (for example the ranges from 1 to 2 and/or from 2 to 4 also includes the combined range from 1 to 4).

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method of calibrating a cement block comprising:

molding the cement block with a calibration protrusion; and adjusting a dimension of the cement block by trimming said calibration protrusion after said molding;

and said trimming leaves a face of said calibration protrusion with a surface area of less than 1/10 of an area of a face from which the calibration protrusion protrudes.

2. The method of claim 1, wherein said trimming is in line with said molding.

3. The method of claim 1, wherein said calibration protrusion includes a ridge on a top face of the cement block and wherein said molding includes forming said ridge with a mold head.

4. The method of claim 1, further comprising conveying the cement block on a conveyer and wherein a long dimension of said calibration protrusion is parallel to movement of conveying.

5. The method of claim 1, wherein said trimming is performed before curing the cement block.

6. The method of claim 1, wherein said trimming includes grinding and is performed after curing of the cement block.

7. The method of claim 1, further comprising, supporting a second block on the calibration protrusion.

8. The method of claim 1, further comprising positioning a second block onto the cement block; and pushing the second block to contact the calibration protrusion.

9. The method of claim 1, wherein a bottom of the cement block is flat and wherein said trimming causes a top of the calibration protrusion to be parallel to the bottom of the cement block.

10. The method of claim 1, wherein said adjusting is to a tolerance of between 1-4 mm.

11. The method of claim 1, wherein said trimming leaves a face of said protrusion with a surface area of less than 1/20 of the area of a face from which the calibration protrusion protrudes.

* * * * *